US005322138A

United States Patent [19]

Siracki

[11] Patent Number: 5,322,138

[45] Date of Patent: Jun. 21, 1994

[54] CHISEL INSERT FOR ROCK BITS

[75] Inventor: Michael A. Siracki, Spring, Tex.

[73] Assignee: Smith International, Inc., Houston, Tex.

[21] Appl. No.: 45,444

[22] Filed: Apr. 8, 1993

Related U.S. Application Data

[63] Continuation-in-part of Ser. No. 744,777, Aug. 14, 1991, abandoned.

[51] Int. Cl.[5] ..... E21B 10/52; E21B 10/58

[52] U.S. Cl. ..... 175/374; 175/426

[58] Field of Search ..... 175/374, 426

[56] References Cited

U.S. PATENT DOCUMENTS

| | | | |
|---|---|---|---|
| 3,442,342 | 5/1969 | McElya et al. | 175/374 |
| 4,108,260 | 8/1978 | Bozarth | 175/374 |
| 4,334,586 | 6/1982 | Schumacher | 175/374 |

*Primary Examiner*—Stephen J. Novosad

*Attorney, Agent, or Firm*—Robert M. Vargo

[57] ABSTRACT

A tungsten carbide chisel insert for rock bits is disclosed having a cylindrical base section and a cutting tip section, the top of the tip section having an elongated crest, the remainder of the cutting tip section below the crest is a contoured surface formed having cross-sections being shaped as to provide for better overall performance.

15 Claims, 4 Drawing Sheets

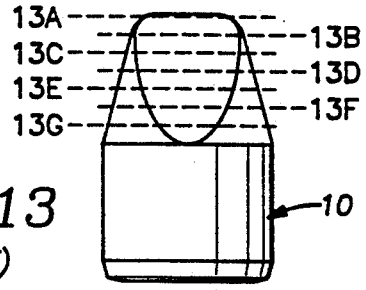
FIG. 13
(PRIOR ART)
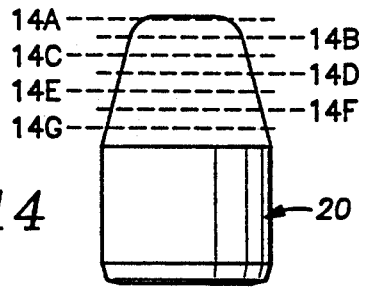
FIG. 14
FIG. 13A 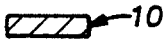
FIG. 14A 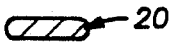
FIG. 13B 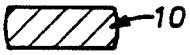
FIG. 14B 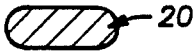
FIG. 13C 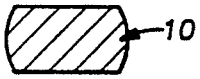
FIG. 14C 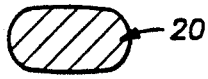
FIG. 13D 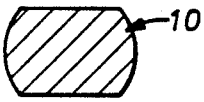
FIG. 14D 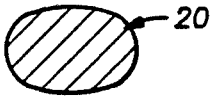
FIG. 13E 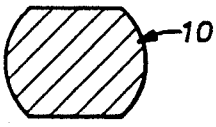
FIG. 14E 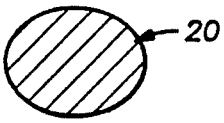
FIG. 13F 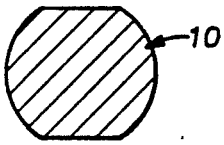
FIG. 14F 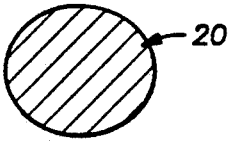
FIG. 13G 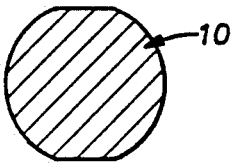
FIG. 14G 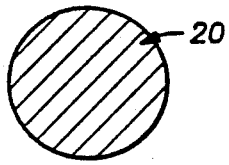

CHISEL INSERT FOR ROCK BITS

CROSS-REFERENCE TO RELATED APPLICATION

This application is a continuation-in-part of application Ser. No. 744,777, filed Aug. 14, 1991, entitled A Chisel Insert For Rock Bits, now abandoned.

BACKGROUND OF THE INVENTION

I. Field of the Invention

This invention relates generally to tungsten carbide insert rock bits and tools of the rolling cutter type and more particularly to the specially shaped and designed inserts utilized thereon.

II. Description of the Prior Art

Rock bits using sintered tungsten carbide inserts generally have a wedge or chisel-shaped configuration for soft to medium hard formations. Various embodiments of such configurations are shown in U.S. Pat. Nos. 3,442,342 and 4,108,260. Such chisel-shaped inserts conventionally have a cylindrical base for retention and a wedge-like projection cutting tip. In all forms of chisel type inserts, flanks are made into the insert by removing material from two opposing sides of a truncated cone. A curvilinear crest formed from a tip radius connects to the top of the two flanks. The remaining truncated cone, a conical surface symmetric with the insert's axis, is joined to the crest with two opposing corner radii that are revolved about the insert's axis. The intersection between the corner radii and the tip radius as well as the intersection between the conical surface and the flanks usually have a blending radius, also known as a round, to eliminate the sharp edge that would otherwise exist.

Blend radii are areas of high stress concentration due to that they are small, typically 0.005 to 0.090 of an inch. These small blend radii typically contribute to or cause the premature breakage of an insert, of which in many cases a less optimum material composition is utilized to overcome this failure mode.

The performance of an insert is primarily dictated by its cutting tip's ability to penetrate into the required formation without having a failure due to breakage or in some cases excessive wear. The tip radius size is predominantly constrained by the desired sharpness curve of an insert cutting tip. The sharpness curve is a plot of the projected cutting tip cross sectional area versus the distance from the top of the cutting tip. To enable sufficient penetration of an insert into a formation the desired sharpness curve is generally obtained by utilizing a small tip radius on the order of 0.075 to 0.125 of an inch.

The conical surface, regardless of whether the flanks are planar, convex, concave, or spherical, or whether the crest intersects the insert axis or is offset from the axis, as shown in the above mentioned patents, is a surface of revolution about the insert axis that adds non-functional material to the insert cutting tip. This additional material adds to the constraint of reducing the tip radius to obtain the desired sharpness curve, which in turn increases the stress concentration on the insert crest and reduces the durability of the insert.

The blend radius on an insert is limited in size by the tip radius, which requires it to be the same size or smaller. In many cases small tip radii will wear away quickly until the initial crest is completely gone. With the crest gone, the blend radii between the conical surface and the flanks is exposed on the cutting surface providing areas of high stress concentration. As the insert tip wears, the surface area of the cutting surface increases, thus the rate of wear decreases which exposes areas of blend radii to more cutting cycles and fatigue leading to chipping and breakage resulting in insert failure.

The sharp edge intersections requiring blending are extremely complex three-dimensional paths. Due to this complex path, the blend radius used on an insert is put into the tooling mold by hand and is typically not controlled from one set of tooling to another, thus a wide variance of blend radii can occur from one production to another of the same insert model which in turn can produce different performance results of one rock bit to another of the same rock bit model.

SUMMARY OF THE INVENTION

It is the object of this invention to provide a chisel-type insert that eliminates blend radii from the cutting tip and the high stress concentrations associated with them. It is also the object of this invention to provide a chisel-type insert having an increased tip radius without sacrificing the ability of the insert to penetrate into the formation or any other pertinent feature of the insert.

In designing the insert, the traditional flanks and conical surface are replaced with one contoured surface that omits the sharp intersections of the prior art inserts that require a blend radius or round. The new contoured single surface is not a surface of revolution about the insert axis as the prior art inserts are. The contoured surface is generated by establishing a set of control curves that provide the desired sharpness curve and passing a surface through them. By modifying one or more of the control curves, the area at those control curves can be decreased or increased to allow the insert to penetrate deeper or shallower into the formation. The insert also omits the sharp intersection and its associated stress concentration at the crest ends between the tip radius and the corner radii by replacing the surfaces with a partial sphere or torus. The contoured surface eliminates non-functional material in the areas where the prior art inserts require blend radii.

An advantage then of the present invention over the prior art is that the reduction in material will allow the insert to penetrate into the formation deeper allowing for better bit performance through faster drilling rates. Another advantage is that the contoured surface allows for the sharpness curve to be adjusted to maintain the insert penetration by increasing the tip radius. By enlarging the tip radius, breakage is reduced due to better stress distribution. Enhanced stress distribution is extremely beneficial when stringers of harder formations are encountered when drilling.

It is preferred that all cross-sections in the cutting tip perpendicular to the insert axis and below the tip radius would have a change in slope less that forty degrees between any two points whose curve length is 5 percent or less of the perimeter of the respective section to allow for a larger tip radius for increased insert durability. It is also preferred to have the majority of the above mentioned sections to be non-circular conic shapes to minimize the area and maximize the radius of curvature throughout the sections while allowing for a larger tip radius than is otherwise available without sacrificing insert penetration into the formation and consequently providing all around better stress distribution.

The above noted objects and advantages of the present invention will be more fully understood upon a study of the following description in conjunction with the detailed drawings.

BRIEF DESCRIPTION OF THE DRAWINGS

FIG. 13 is a front elevational view of the prior art chisel insert showing where the section lines 13 A to 13 G are taken;

FIGS. 13 A to 13 G are sectional views taken from respective sections of the insert of FIG. 13;

FIG. 14 is a front elevational view of the insert of the present invention showing where the section lines 14 A to 14 G are taken;

FIGS. 14 A to 14 G are sectional views taken from respective sections of the insert of FIG. 14;

Figure 1:
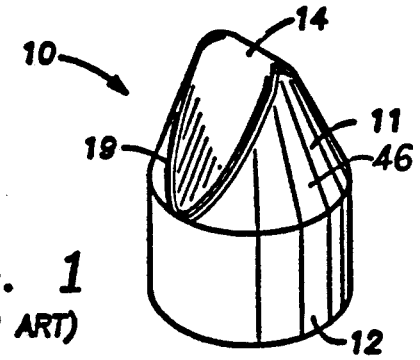
FIG. 1 (PRIOR ART)
FIG. 1 is an isometric view of a conventional prior art chisel insert.
Figure 2:
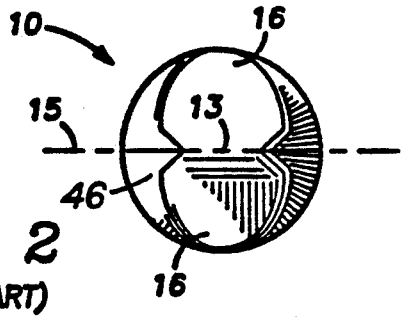
FIG. 2 (PRIOR ART)
FIG. 2 is a top elevational view of the prior art chisel insert.
Figure 3:
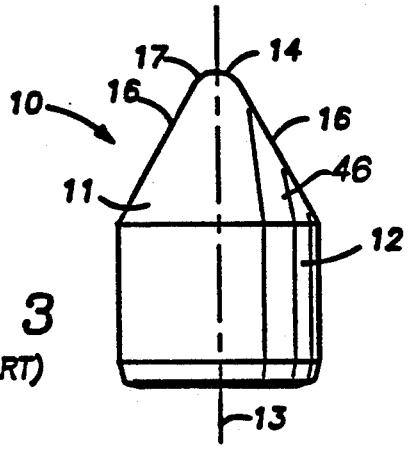
FIG. 3 (PRIOR ART)
FIG. 3 is a side elevational view of the prior art chisel insert.
Figure 4:
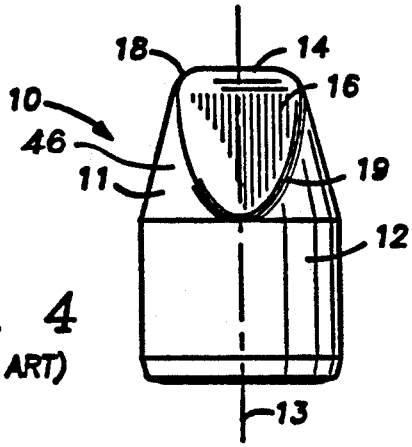
FIG. 4 (PRIOR ART)
FIG. 4 is a front elevational view of the prior art chisel insert.
Figure 5:
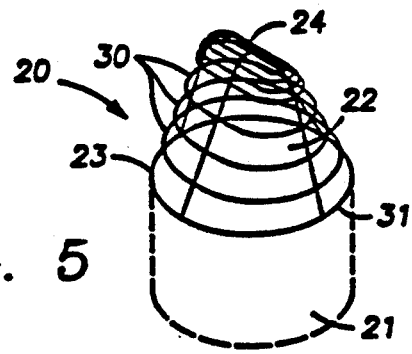
FIG. 5 is an isometric schematic view of an insert showing the control curves utilized in the construction of the insert made in accordance with the present invention.
Figure 6:
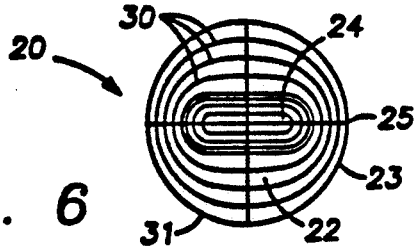
FIG. 6 is a top elevational schematic view of the insert of the present invention.
Figure 7:
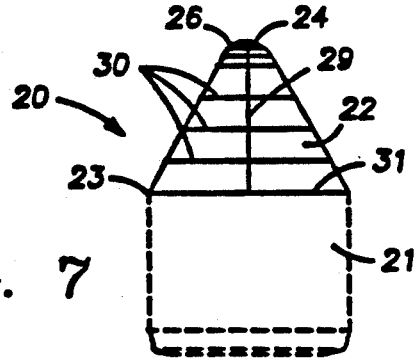
FIG. 7 is a side elevational schematic view of the insert of the present invention.
Figure 8:
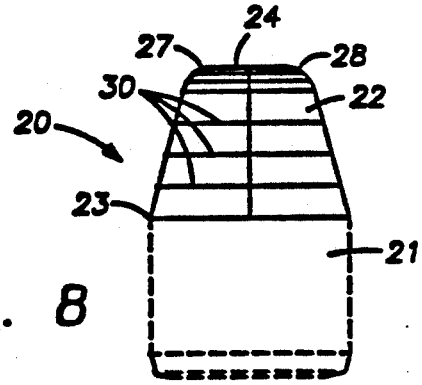
FIG. 8 is a front elevational schematic view of the insert of the present invention.
Figure 9:
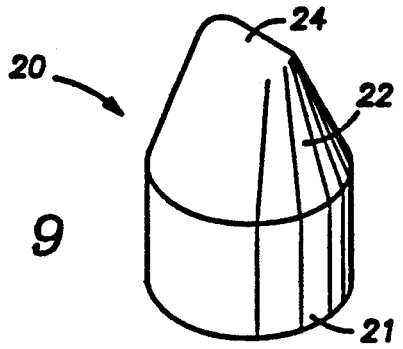
FIG. 9 is an isometric view of the insert of the present invention.
Figure 10:
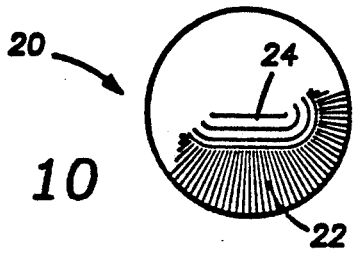
FIG. 10 is a top elevational view of the insert shown in FIG. 9.
Figure 11:
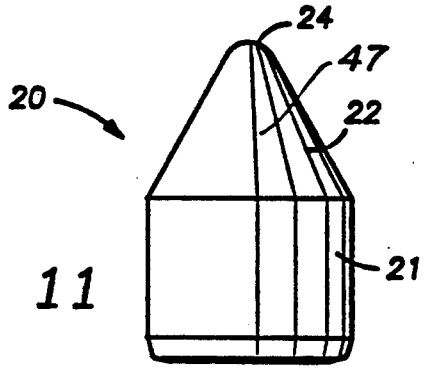
FIG. 11 is a side elevational view of the insert shown in FIG. 9.
Figure 12:
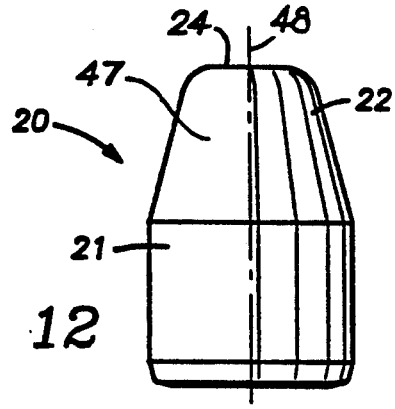
FIG. 12 is a front elevational view of the insert shown in FIG. 9.
Figure 16:
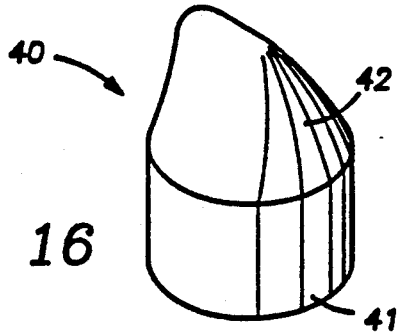
FIG. 16 is an isometric view of the second embodiment of the present invention.
Figure 17:
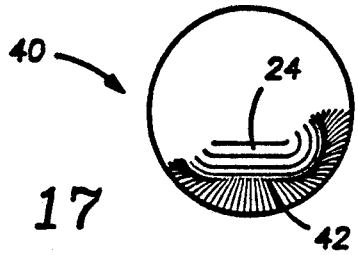
FIG. 17 is a top elevational view of the second embodiment.
Figure 18:
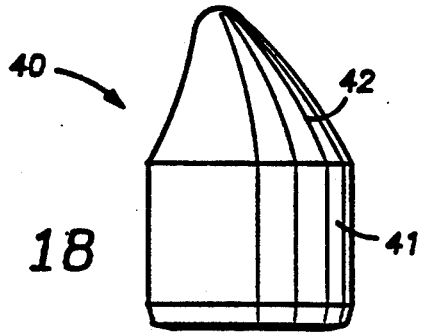
FIG. 18 is a side elevational view of the second embodiment.
Figure 19:
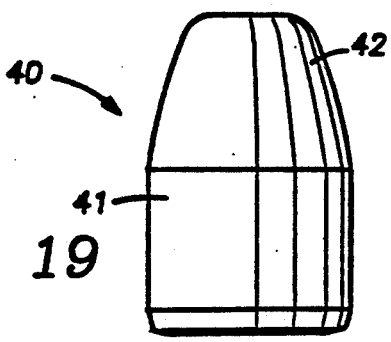
FIG. 19 is a front elevational view of the second embodiment.

DESCRIPTION OF THE PREFERRED EMBODIMENTS AND BEST MODE FOR CARRYING OUT THE INVENTION

Referring now to the drawings FIGS. 1 to 4 illustrates a conventional, prior art, chisel-shaped insert 10 having a cutting tip portion 11 and an integral base portion 12, the latter being typically cylindrical and both parts being centered about an axis 13 of the base.

The cutting tip 11 of insert 10 has its outermost extremity formed with a curvlinear crest 14 having a median line 15 which divides the crest 14 into two equal and symmetric halves. In addition, a plane through the longitudinal axis 13 and the median line 15 of the crest 14 divides the cutting tip as well as the entire insert into two halves symmetric in such plane. Cutting tip 11 also has a pair of flanks 16 disposed at generally equal angles to such plane of symmetry and axis 13, 29 degrees as illustrated or a 58 degree included angle between flanks 16. Thus flanks 16 generally converge toward crest 14. The balance of the cutting tip 11 is a conical surface 46 symmetric about axis 13.

The crest 14 is round in the direction along its median line 15 and it is also rounded in the direction athwart its median line, as shown by the tip radius 17 and corner radii 18. The tip radius 17 is tangent to flanks 16, while the corner radii 18 are tangent to the conical surface 45.

Flanks 16 are shown as being flat, although they could also be spherical, convex, and/or concave. The intersection 19 between the flanks 16 and the conical surface 45 and between the tip radius 17 and the corner radius 18 is preferably blended or rounded. The typical blend radius size is from 0.005 to 0.090 of an inch.

All of the above described radii and rounds are incorporated in the inserts prior to sintering, either in the pressing mold or by machining the pressed green insert before it is sintered.

FIGS. 5 through 8 illustrate schematically the insert made in accordance with the present invention. The insert, generally indicated by arrow 20 includes a cylindrical base 21, shown in broken lines. This base construction is conventional in nature and is similar to the base construction 12 of the prior art insert shown in FIGS. 1 through 4. The control curves 30 are used to generate the cutting tip 22 surface.

Also referring to FIGS. 9–12, the novelty lies in the cutting tip portion 22. This cutting tip 22 comprises a circular base 23 formed at its lower end while the upper end terminates with a crest 24. The crest 24 is characterized by the fact that the crest is rounded along the median line 25 having a given radius 26. In addition, the ends 27 of the crest 24 are partial spheres having a corner radius 28 which is the same as the tip radius 26 and is also tangent to the contoured surface 47 in all planes.

In the preferred embodiment, the spherical ends 27 of the crest 24 would be partial tori with the corner radii 28 being larger than the tip radius 26. In either case, when using the spherical ends 27 or tori ends on the crest 24, there is no intersection 19 on them requiring blends or rounds as there is on the prior art inserts as shown in FIGS. 1 through 4 of the prior art insert 10. The contoured surface 47 joins the crest 24 to the insert base 21. The contoured surface 47 does not have any abrupt change in direction on it requiring blending or rounds as the intersection 19 between the planks 16 and the conical surface 46 require as shown in FIGS. 1 through 4 of the prior art insert 10. Planar sections of the contoured surface 47 taken perpendicular to the insert axis 48 have a change in slope less than forty degrees between any two points on the section having a curve length five percent or less of the section's perimeter. It should be pointed out that the contoured surface 47 defined by the cross sections 30 taken in succession in a direction along the insert axis includes a conic-shaped portion.

A plane 29 through the longitudinal axis of the insert and the median line 26 of the crest 24 divides the cutting tip 22 as well as the entire insert 20 into two halves symmetric in such plane.

FIGS. 13 and 14 illustrate the point that the insert made in accordance with the present invention is a sharper insert, prior to and during wear, than a conventional prior art insert. FIGS. 13 A–G show the various cross-sections of the prior art insert 10 with planar flanks taken along the planes perpendicular to the insert axis indicated in FIG. 13. It should be noted that if the prior art insert flanks 10 were convex, the straight line segments on the cross-sections in FIGS. 13 A–G would be slightly curved. FIGS. 14 A–G show the same cross-sections of the insert 20 of the present invention taken along the planes perpendicular to the insert axis indicated in FIG. 14.

The present invention insert 20 and the prior art insert 10 in FIGS. 14 and 13 respectively, have the same base diameter, cutting tip height, crest length, tip radius, corner radii, and flank angle. As can be seen in the present invention, insert 20 sections in FIGS. 14 A–G, they omit non-functional material that the prior art insert 10 section in FIGS. 13A–13G have that leave a sharp intersection requiring a blend radius or round.

Figure 15:
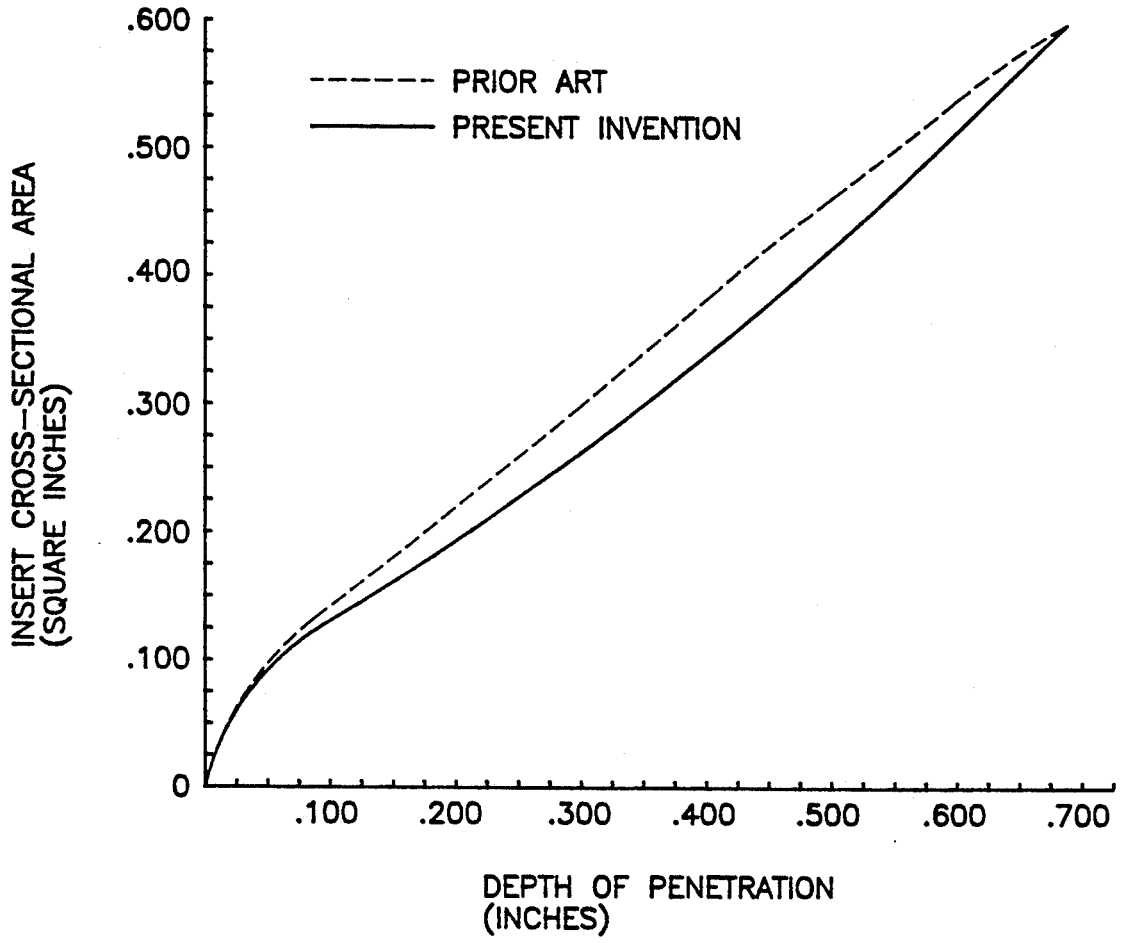
FIG. 15 is a graphical representation comparing a prior art insert to the insert of the present invention, plotting cross-sectional area versus depth of penetration.

FIG. 15 illustrates graphically the cross-sectional area comparison between the prior art insert 10 and the insert 20 of the present invention. Each insert was the size to fit onto a 17-½ inch soft-formation rock bit and both had the same base cross-sectional area. The depth of penetration illustrated means the distance from the crest of the insert to the base. As can be seen, the cross-sectional area of the insert 20, shown in a solid line, is smaller than the prior art insert 10, shown in broken lines, at nearly all points of penetration.

As stated earlier, this enables the insert 20 to be sharper initially and as it is dulled than the prior art insert 20, while still having higher strength attributes because of having less stress risers. It also allows the insert to penetrate deeper into the formation, providing a faster rate of penetration.

For example, referring to the graph again in FIG. 15, taking a given formation compressive strength $\alpha$ weight on bit per insert P, and the projected cross-sectional area A, where $A=P/\alpha=0.35$ square inches, the prior art insert 10 would penetrate to about 0.360 inches and the present invention insert 20 would penetrate to about 0.415 inches, an increase of 0.055 inches. To prevent the insert 20 from penetrating into the formation the additional 0.055 inches, the insert 10 could have a larger tip radius 26 per FIGS. 5–8 incorporated for better stress distribution and durability without sacrificing penetration into the formation.

FIGS. 16 through 19 illustrate another embodiment of the present invention. This embodiment shows an asymmetrical insert 40 having a cylindrical base 41 and a cutting tip 42. The cutting tip 42 has at its outermost extremity formed with a crest 43 that is located to the one side of the insert axis.

The transition from the crest 43 to the base 41 is again accomplished with a plurality of control curves that become generally larger as they descend. However, it should be noted that there is not a straight line relationship from crest to the base. The control curves are sized and oriented to shift the mass to the trailing edge 44 and have the leading edge 45 have a concavity formed thereon. The basic construction is somewhat similar to the insert shown in U.S. Pat. No. 4,108,260 with the exception that the crest is not on the longitudinal axis. Moreover, the insert 40 preferably does not have any planar or straight surfaces forming the leading and trailing edge. The insert 40, with its continuously curved cross-sections extending down the insert from the crest, has smooth non-tangential intersections in order not to create high stress areas.

As can be seen, a chisel insert made in accordance with the present invention can have various shapes, be symmetrical or asymmetrical, and be made to be more durable while maintaining or increasing performance.

It will of course be realized that various modification can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A shaped insert for a rolling cone rock bit having a base section and a cutting tip section, said base section being generally cylindrical and is adapted to extend into a matching hole formed in the bit cone, the longitudinal axis of the base forming the axis of the insert, the upper end of the cutting tip section, furthest away from the base section, comprises an elongated crest with the remainder of the cutting tip section below the crest being formed with an outer contoured surface joining said crest to the base of the insert wherein said contoured surface does not contain a surface of revolution about the insert axis.

2. The insert of claim 1 wherein the ends of said crest are partial spheres or tori being tangential to the crest and the contoured surface without blend radii or rounds.

3. The invention of claim 1 wherein a portion of cross-sections of said contoured surface when taken together successively along the axis of the insert define a portion of a conically-shaped surface.

4. The invention of claim 1 wherein the area of a portion of the cross-sections of said contoured surface normal to the insert axis are more than five percent less than the area of a corresponding cross-section of a conventional chisel insert having the same base diameter, cutting tip height, crest length, tip radius, corner radius and flank angle.

5. The invention of claim 4 wherein the cross-sections become progressively larger and more closely approximate an ellipse as they approach the base section of the insert.

6. The invention of claim 1 wherein said crest intersects said insert axis.

7. The invention of claim 1 wherein said crest is offset from said insert axis.

8. The invention of claim 6 wherein a portion of cross-sections of the said cutting tip surface when taken together successively along the axis of the insert define a portion of a conically-shaped surface.

9. The invention of claim 7 wherein a portion of cross-sections of the said cutting tip surface when taken together successively along the axis of the insert define a portion of a conically-shaped surface.

10. The invention of claim 7 wherein said cross-sections are sized and oriented with respect to the insert axis to enable the cutting tip section to have a concave leading edge and a convex trailing edge.

11. The invention of claim 1 wherein said cross-sections are sized and oriented with respect to the insert axis to enable the cutting tip section to have a concave leading edge and a convex trailing edge.

12. A shaped insert for a rolling cone rock bit having a base section and a cutting tip section, said base section being generally cylindrical and is adapted to extend into a matching hole formed in the bit cone, the longitudinal axis of the base forming the axis of the insert, the upper end of the cutting tip section, furthest away from the base section, comprises an elongated crest, the remainder of the cutting tip section below the crest having a portion of non-circular cross-sections normal to insert axis being shaped to have a continuous curve in which the maximum change in the slope between any two points on the perimeter of said curve, approximately five percent of the perimeter apart, is forty degrees.

13. The invention of claim 12 wherein a portion of said cross-sections of the cutting tip outer surface below the crest when taken together successively along the axis of the insert define a portion of a conically-shaped surface.

14. A shaped insert for a rolling cone rock bit having a base section and a cutting tip section, said base section being generally cylindrical and is adapted to extend into a matching hole formed in the bit cone, the longitudinal axis of the base forming the axis of the insert, the upper end of the cutting tip section, furthest away from the base section, comprises an elongated crest that has partial spherical or toridal ends being tangential to the crest without a blending radius or round.

15. A shaped insert for a rolling cone rock bit having a base section and a cutting tip section, said base section being generally cylindrical and is adapted to extend into a matching hole formed in the bit cone, the longitudinal axis of the base forming the axis of the insert, the upper end of the cutting tip section, furthest away from the base section, comprises an elongated crest with the remainder of the cutting tip below the crest having a portion of cross-sections when taken together successively along the axis of the insert define a portion of a conically-shaped surface.

* * * * *